US010011398B2

(12) United States Patent
Armstrong

(10) Patent No.: US 10,011,398 B2
(45) Date of Patent: Jul. 3, 2018

(54) CLOSURE WITH A SLIDER FOR BAG

(71) Applicant: Stephen G. Armstrong, Toronto (CA)

(72) Inventor: Stephen G. Armstrong, Toronto (CA)

( * ) Notice: Subject to any disclaimer, the term of this patent is extended or adjusted under 35 U.S.C. 154(b) by 183 days.

(21) Appl. No.: 14/886,840

(22) Filed: Oct. 19, 2015

(65) Prior Publication Data

US 2016/0107801 A1 Apr. 21, 2016

Related U.S. Application Data

(60) Provisional application No. 62/065,174, filed on Oct. 17, 2014.

(51) Int. Cl.
*B65D 33/25* (2006.01)

(52) U.S. Cl.
CPC ..... *B65D 33/2591* (2013.01)

(58) Field of Classification Search
CPC ..... B65D 33/2591; B65D 33/2541; B65D 33/2508; Y10T 24/2564; Y10T 24/2582; Y10T 24/2534; Y10T 24/15; Y10T 24/2543; Y10T 24/2532
See application file for complete search history.

(56) References Cited

U.S. PATENT DOCUMENTS 5,638,586 A * 6/1997 Malin ..... B65D 33/2591 24/584.1
5,809,621 A * 9/1998 McCree ..... B65D 33/2591 24/399
5,871,281 A * 2/1999 Stolmeier ..... B65D 33/2591 24/417
6,047,450 A * 4/2000 Machacek ..... B65D 33/2591 24/399
6,290,390 B1 * 9/2001 Buchman ..... B65D 33/2591 383/204
6,290,391 B1 * 9/2001 Buchman ..... B65D 33/2591 383/204
6,491,432 B2 * 12/2002 May ..... B65D 33/2591 24/400
6,679,027 B2 * 1/2004 Schreiter ..... B65D 33/2591 53/133.4
6,880,972 B2 * 4/2005 Plourde ..... B65D 33/2591 24/399
7,496,992 B2 * 3/2009 Ausnit ..... B65D 33/2591 24/30.5 R (Continued)

*Primary Examiner* — Jason W San
(74) *Attorney, Agent, or Firm* — Adler Pollock & Sheehan P.C.; Daniel J. Holmander, Esq.

(57) ABSTRACT

A reclosable bag zipper having a female profile assembly that terminates in a first curled end. A male profile assembly opposes the female profile assembly to selectively close the opening. The male profile assembly terminates in a second curled end. A riser is formed by non-uniform portions of the curled ends at one end of the bag. The slider has a dividing member and depending opposing first and second sides that define a central channel for receiving the curled ends. The curled ends create a distal bias against the slider, wherein: the first and second sides engage the profiles when moved in a closing direction; the dividing member separates the profiles when moved in an opening direction opposite to the closing direction; and when the slider is moved in the closing direction onto the riser, the dividing member moves distally away from the profiles so that the zipper may be fully closed.

17 Claims, 15 Drawing Sheets

(56) References Cited

U.S. PATENT DOCUMENTS 7,553,082 B2 * 6/2009 Yoder ..... B65D 33/20 383/210.1
7,610,662 B2 * 11/2009 Ausnit ..... B65D 33/2591 24/30.5 R
7,784,160 B2 * 8/2010 Dais ..... B65D 33/2508 24/585.12
7,797,802 B2 * 9/2010 Ackerman ..... B65D 33/2591 24/416
7,849,565 B2 * 12/2010 Swain ..... A44B 19/267 24/30.5 R
8,096,022 B2 * 1/2012 Hui ..... B65B 9/20 24/30.5 R
8,256,959 B2 * 9/2012 Hui ..... B65D 33/2591 383/59
8,714,819 B2 * 5/2014 Hui ..... B65B 9/20 24/30.5 R
9,187,215 B2 * 11/2015 Blythe ..... B65D 33/2591
9,216,845 B2 * 12/2015 Ausnit ..... B65D 33/2591
9,510,651 B2 * 12/2016 Blythe ..... A44B 19/62
2004/0037479 A1 * 2/2004 Bentsen ..... B65D 33/2591 383/64
2004/0045138 A1 * 3/2004 Kasai ..... B65D 33/2591 24/399
2004/0136618 A1 * 7/2004 Ausnit ..... B65D 33/2591 383/64
2006/0120630 A9 * 6/2006 Ausnit ..... B65D 33/2591 383/64
2007/0098305 A1 * 5/2007 Tilman ..... B65D 33/2591 383/64
2009/0226119 A1 * 9/2009 Hatakeyama ..... B65D 33/2525 383/42
2016/0101905 A1 * 4/2016 Turvey ..... B65D 33/2591 383/64
2017/0121062 A1 * 5/2017 Chapek ..... B65D 33/2591
2017/0190477 A1 * 7/2017 Hui ..... B65D 33/2591
2017/0210511 A1 * 7/2017 Chaturvedi ..... B65D 33/2591

* cited by examiner

CLOSURE WITH A SLIDER FOR BAG

CROSS-REFERENCE TO RELATED APPLICATION

This application claims priority to U.S. Provisional Patent Application No. 62/065,174 filed Oct. 17, 2014, which is incorporated herein by reference.

BACKGROUND OF THE DISCLOSURE

1. Field of the Disclosure

The present disclosure relates to closure mechanisms for reclosable pouches and bags, and more particularly, to such closure mechanisms that utilize a slider to facilitate opening and/or closing.

2. Background of the Related Art

Thermoplastic bags are used to store items as varied as small snacks to multiple large comforter blankets. Typically, a closure mechanism allows selective sealing and unsealing of the bag. Use of closure mechanisms has been widely used and well understood in the art. However, closure mechanisms can create frustration by having difficult and unreliable operation. To overcome these drawbacks, closure mechanisms often include a slider to facilitate closing and opening of the bag.

Some examples are illustrated in the following: U.S. Pat. No. 7,287,904 issued on Oct. 30, 2007 to Withers; U.S. Pat. No. 7,574,781 issued on Aug. 18, 2009 to Ackerman et al.; U.S. Pat. No. 8,690,430 issued on Apr. 8, 2014 to Burggren; U.S. PG Pub. No. 2003/0053722 published on Mar. 20, 2003 to Eggermont; U.S. PG Pub. No. 206/0008187 published on Jan. 12, 2006 to Armstrong; and U.S. Pat. No. 5,947,603 issued on Sep. 7, 1999 to Tilman.

SUMMARY OF THE INVENTION

Despite the advances in closure mechanisms with sliders for plastic bags, deficiencies remain in that incomplete sealing of the closure mechanism occurs. This results in a seal that may not be water-tight or air-tight to create an effectively sealed storage bag, a tighter, stiffer, and stronger closure profile is required. In order to effectively and easily close such an air and water-tight closure mechanism, a slider is required. Sliders are typically rigid to ensure the closure mechanism is closed along the entire length, not just in some areas and not others. Simply using one's fingers often will not close these types of closures, which may have multiple profiles, to ensure air or water tightness. Therefore, there is a need for a storage bag that includes a non-removable slider to open the bag when pulled in one direction and close the bag when slid in the other direction, while maintaining a waterproof and air tight seal when in the closed position.

Further, prior art sliders are prone to improperly coming off the storage bag which greatly inconveniences the user. This phenomenon is particularly problematic when overfilling the bags, then trying to close them. Thus, a slider that is affirmatively secured to the bag as well as held in a proper position is desired.

In one embodiment, the subject technology is directed to a zipper for a reclosable bag including a female profile assembly along an opening of the bag and a male profile assembly along the opening and opposing the female profile assembly, wherein the female and male profile assemblies selectively engage to close the opening. A guide forms a riser at a side of the bag. A slider mounts on the bag to engage the male and female profile assemblies together. The slider has a central body with depending opposing first and second sides for engaging the profiles when moved in a closing direction. A dividing member separates the profiles when moved in an opening direction opposite to the closing direction. The guide engages the slider so that as the slider is moved in the closing direction onto the riser, the dividing member moves distally away from the profiles so that the zipper may be folly closed.

Another embodiment of the subject disclosure is direction to a closure for a reclosable bag having opposing members for selectively closing the bag and a slider coupled to the opposing members for engaging the opposing members together. At least one guide extends along an opening of the bag and couples to the slider for orienting the slider to the opposing members.

Still another embodiment of the subject technology is directed to a zipper for a reclosable bag including a female profile along a first backing to form an opening of the bag, and a male profile along a second backing and opposing the female profile, wherein the female and male profiles selectively engage to close the opening. A slider slidingly mounts on the bag for engaging the male and female profiles together. The slider has a central body with depending first and second sides for closing the profiles and a dividing member for separating the profiles depending upon a direction of movement of the slider. At least one branch is adjacent to at least one of the profiles so that as the slider is moved to separate the profiles, the at least one branch contacts the dividing member to assist with separating the profiles.

BRIEF DESCRIPTION OF THE DRAWINGS

These and other features, aspects, and advantages of the present invention will become better understood with reference to the following description, appended claims, and accompanying drawings.

DESCRIPTION OF THE PREFERRED EMBODIMENT

Figure 1:
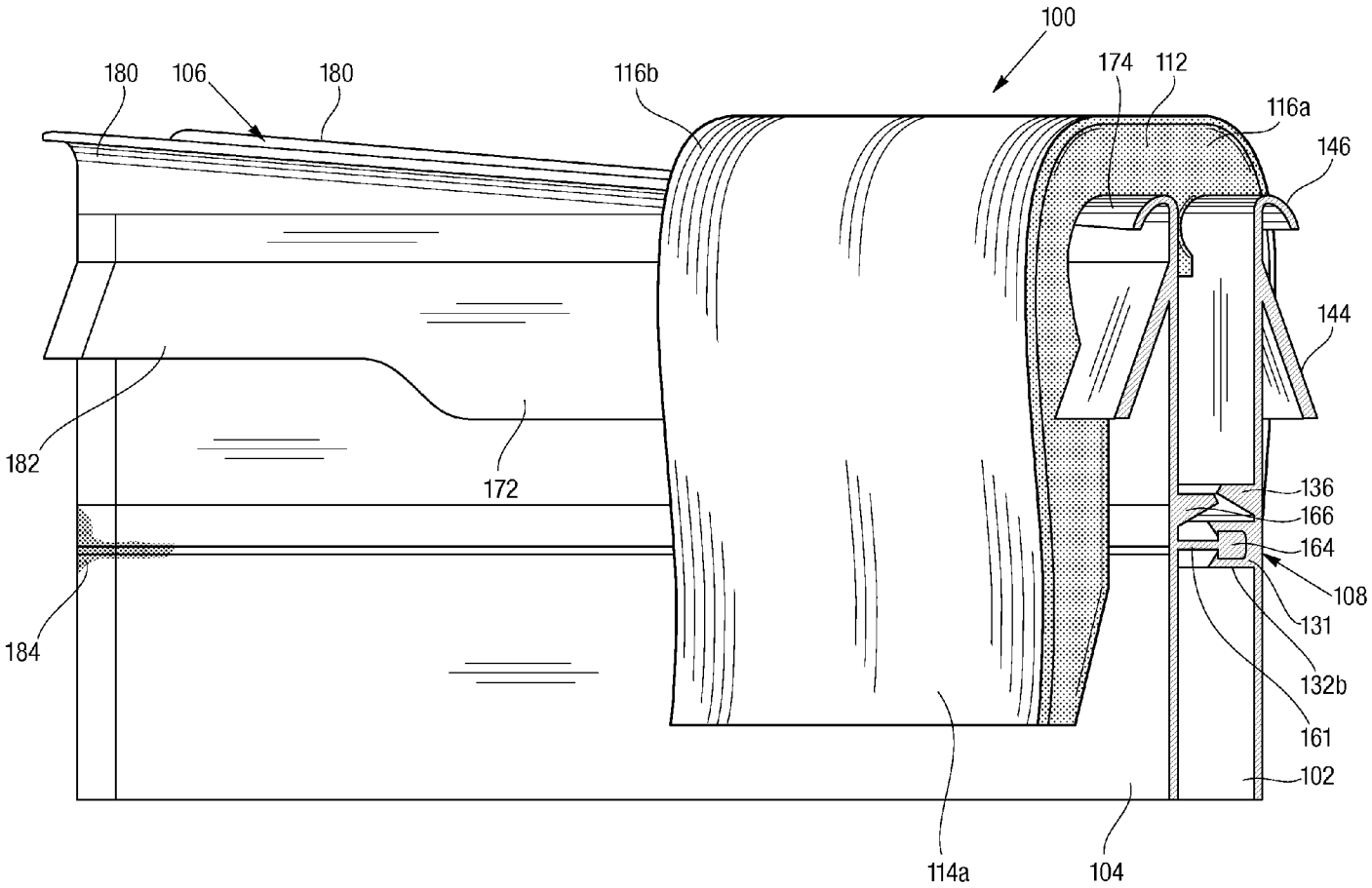
FIG. 1 is a partial perspective view of a zipper with a slider for a reclosable bag in accordance with the subject technology.

The present disclosure overcomes many of the prior art problems associated with closure mechanisms with sliders for plastic bags and the like. The advantages and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Unless otherwise specified, the illustrated embodiments can be understood as providing exemplary features of varying detail of certain embodiments, and therefore, unless otherwise specified, features, components, modules, elements, and/or aspects of the illustrations can be otherwise modified, combined, interconnected, sequenced, separated, interchanged, positioned, and/or rearranged without materially departing from the disclosed systems or methods.

It is also noted that the accompanying drawings are somewhat idealized in that, for example without limitation, features are shown as substantially smooth and uniform when in practice, manufacturing variances and abnormalities would occur as is known to those of ordinary skill in the art. Use of relative terms such as up, down, left, right is with respect to the FIGS. and not meant in a limiting manner.

Figure 2:
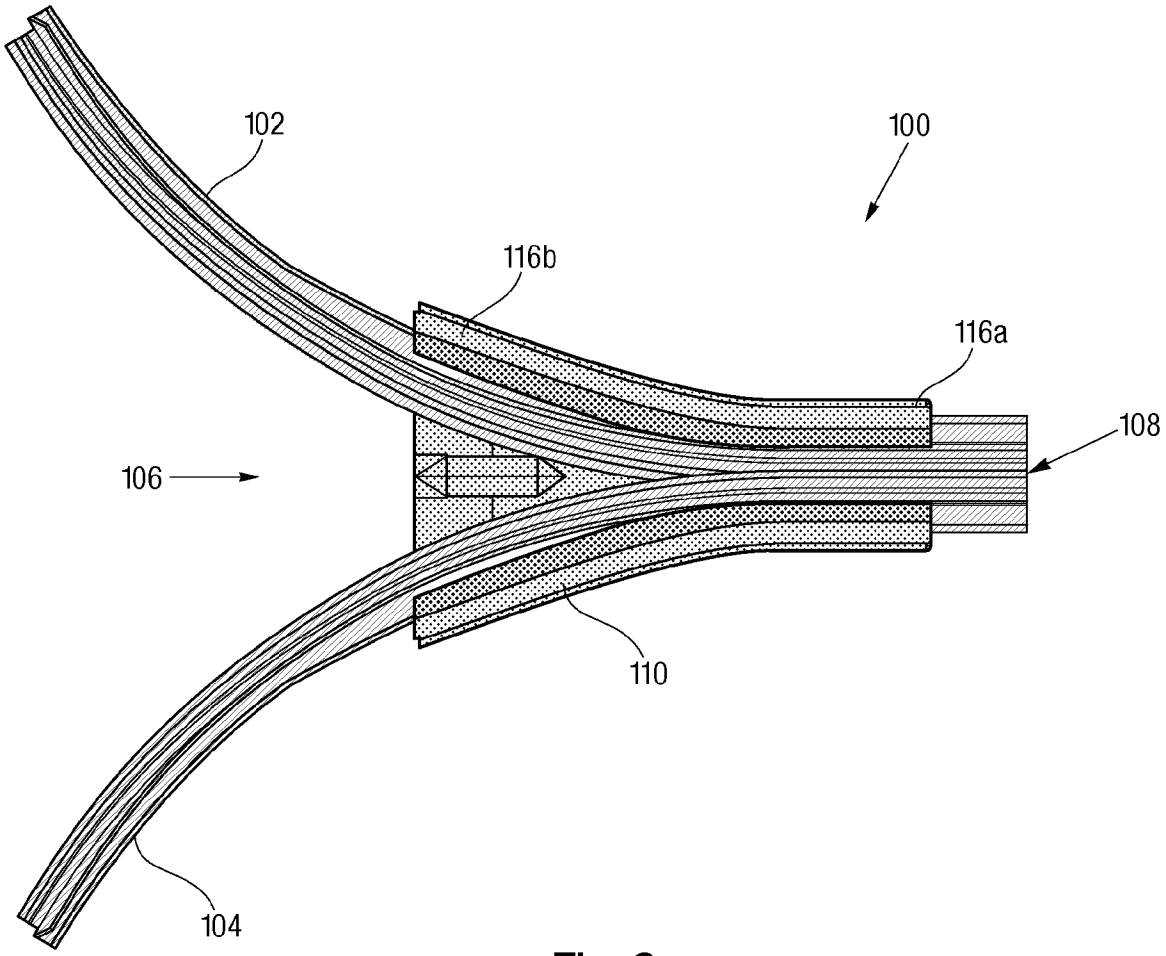
FIG. 2 is a top view of a zipper with a slider for a reclosable bag in accordance with the subject technology.

Referring to FIGS. 1 and 2, a partial perspective view and a top view of a reclosable bag 100 are shown. The reclosable bag 100 has opposing walls 102, 104 that are sealed together to form an opening 106. A zipper 108 with a slider 110 selectively seals the bag 100. In brief overview, as the slider 110 moves to the left in FIGS. 1 and 2, the zipper 108 is closed for a water-tight seal. As the slider 110 moves to the right, the walls 102, 104 are separated to create the opening 106 (i.e., the bag 100 opens).

Figure 3B:
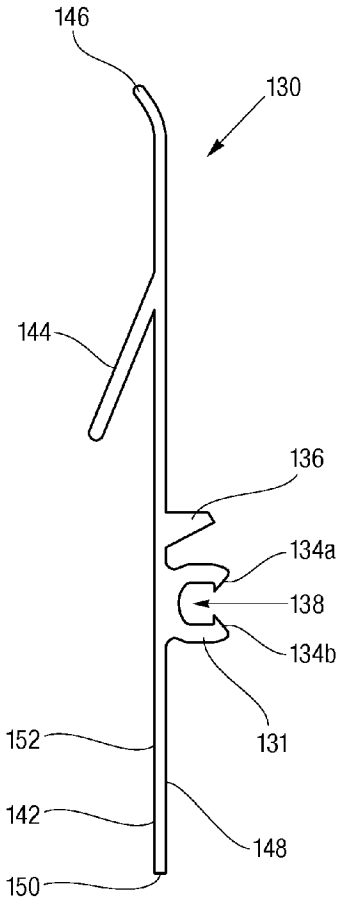
FIG. 3B is a cross-sectional view of the groove profile of FIG. 3A taken along line 3A-3A.
Figure 3A:
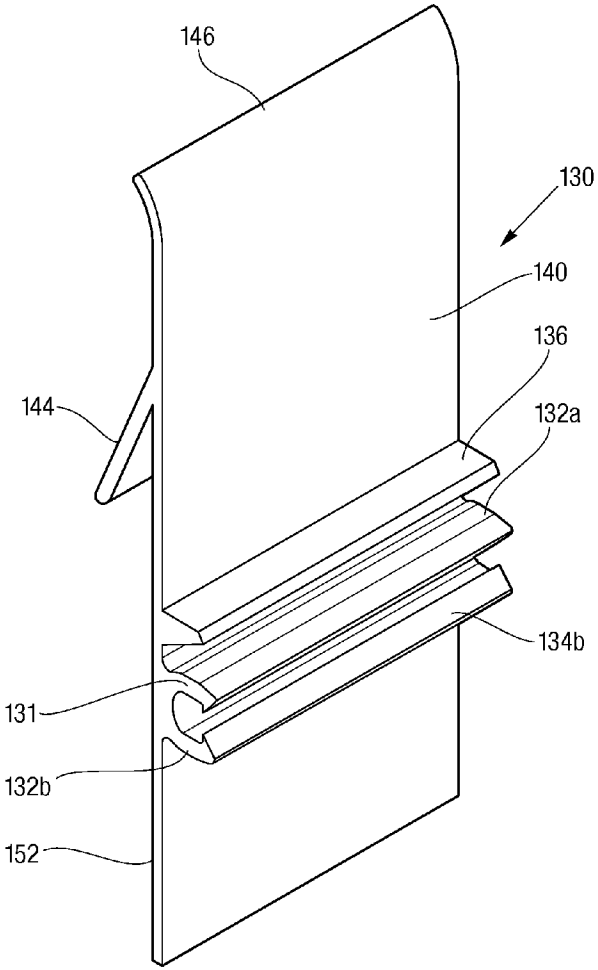
FIG. 3A is a perspective fragmentary view in cross-section of a female groove profile assembly of a zipper in accordance with the subject technology.

Referring now to FIGS. 3A and 3B, a perspective fragmentary view and a cross-sectional view of a female groove profile assembly 130 of the zipper 108 is shows. The female groove profile assembly 130 is separately extruded with a backing 152, then applied to the wall 102. The female groove profile assembly 130 includes a female profile 131 with opposing legs 132*a*, 132*b* upstanding from the wall 102 to form a groove 138 on an inner side 140. Each leg 132*a*, 132*b* terminates in a distal hook 134*a*, 134*b*, respectively.

The female groove profile assembly 130 also includes a trapezoidal-shaped branch 136 adjacent to the leg 132*a*. On an outer side 142, the female groove profile assembly 130 has a depending guide finger 144. Generally, the female groove profile assembly 130 terminates in a distal outwardly bent or curled end 146.

Figure 4B:
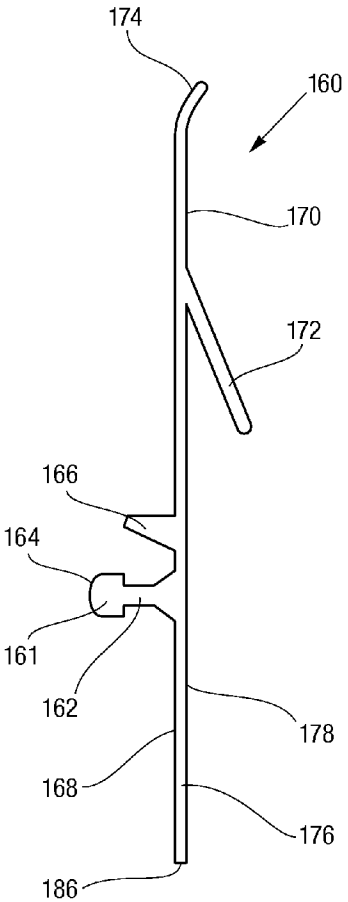
FIG. 4B is a cross-sectional view of the male rib profile of FIG. 4A taken along line 4A-4A.
Figure 4A:
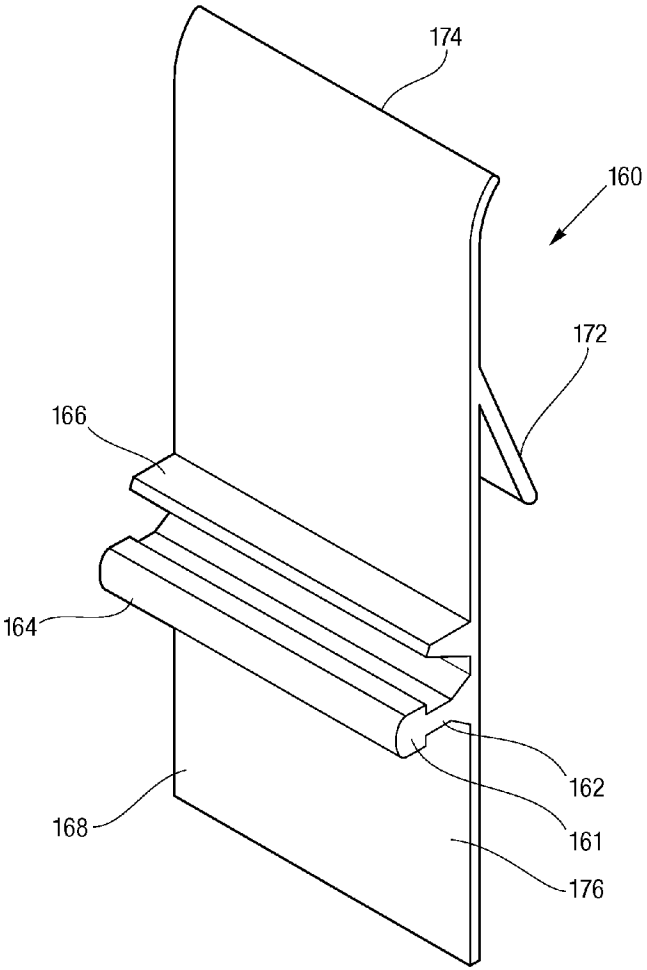
FIG. 4A is a perspective fragmentary view in cross-section of a male rib profile of a zipper in accordance with the subject technology.
Figure 5C:
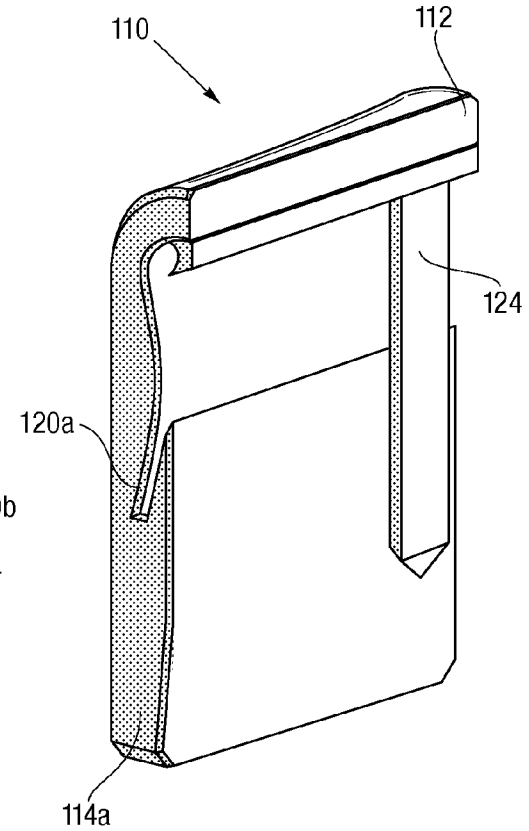
FIG. 5C is an opening end view of a slider of a closure mechanism in accordance with the subject technology.
Figure 5B:
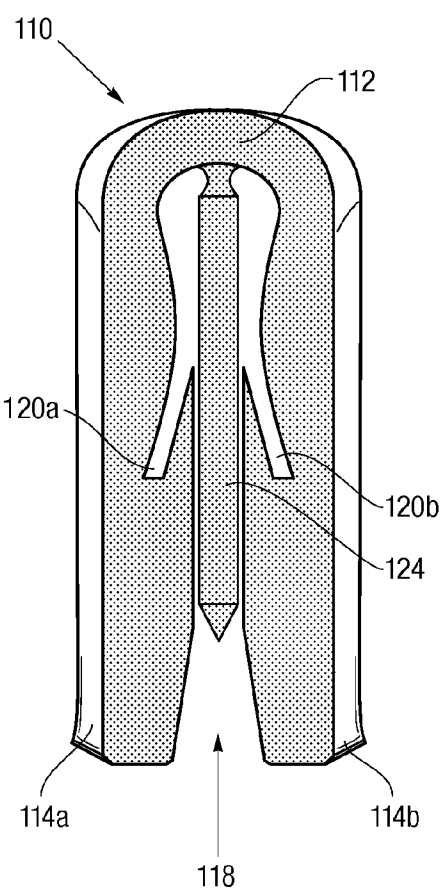
FIG. 5B is a closing end view of a slider of a closure mechanism in accordance with the subject technology.
Figure 5A:
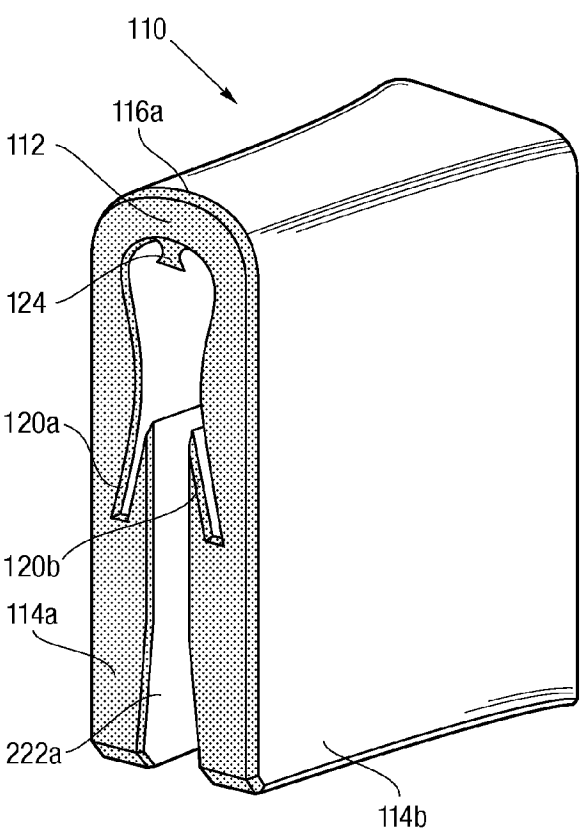
FIG. 5A is a perspective view of a slider of a closure mechanism in accordance with the subject technology.
Figure 5D:
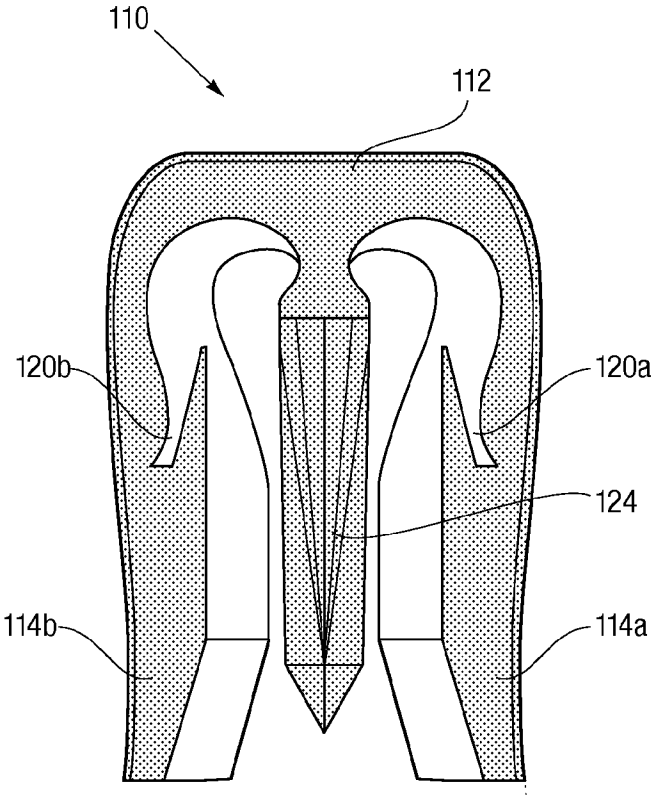
FIG. 5D is a partial cut-away view of a slider of a closure mechanism in accordance with the subject technology.

Referring now to FIGS. 4A and 4B, a perspective fragmentary view and a cross-sectional view of a male rib profile 160 of the zipper 108 is shown. In the shown embodiment, the male rib profile 160 is also separately extruded with a backing 176, then applied to the wall 104. On an inner side 168, the male rib profile 160 includes an upstanding stem 162 that terminates in a distal head 164. The stem 162 and head 164 are sized to selectively engage the opposing legs 132*a*, 132*b* in a water-tight manner.

The male rib profile 160 also includes a trapezoidal-shaped branch 166 adjacent to the stem 162. On an outer side 170, the male rib profile 160 also has a depending guide finger 172. Generally, the male rib profile 160 terminates in a distal outwardly curled end 174. Without being limited to any particular theory of operation, the functionality of the branches 136, 166, guide fingers 144, 172 and curled ends 146, 174 is described in detail below. It is envisioned that the branches 136, 166, guides 144, 172 and ends 146, 174 could be any of a variety of shapes and combinations. For example, the guides could be straight at any angle, curled, Y-shaped, L-shaped, U-shaped and the like. The ends could be straight, wave-shaped, S-shaped and the like.

Referring now to FIGS. 3A-4B, in one embodiment, a lower portion 148 of the female groove profile 130 below the leg 132*b* is approximately 7.156 mm, a separation between the opposing legs 132*a*, 132*b* is approximately 1.2 mm, a distance from a bottom edge 150 of the female groove profile assembly 130 to the utmost top of the branch 136 is approximately 10.056, and the guide finger 144 is at approximately 22 degrees with respect to the backing 152, which is approximately 0.3 mm thick.

In one embodiment, a lower portion 178 of the male rib profile 160 below the stem 162 is approximately 7.456 mm, the stem 162 is approximately 0.6 mm, a distance from a bottom edge 186 of the male rib profile 160 to the utmost top of the branch 166 is approximately 10.395, and the guide finger 172 is at approximately 22 degrees with respect to the backing 172, which is also approximately 0.3 mm thick. In another embodiment, the groove profiles 130, 160 are co-extruded with the respective walls 102, 104.

Referring now to FIGS. 5A-D, perspective, end and cut-away views of the slider 110 are shown. The slider 110 includes a central upper body 112 with opposing depending sides 114*a*, 114*b* to define a central channel 118 for receiving the zipper 108. The central channel 118 is open at the bottom. The top of the central channel 118 is curved and bulbous to form a complimentary shape to accommodate the outwardly curled ends 146, 174. Each side 114*a*, 114*b* defines a slot 120*a*, 120*b* that captures the depending guide fingers 144, 172.

As best seen in FIG. 2, the slider 110 has a sealing end 116*a* and a wider separating end 116*b*. When the slider 110 is moved so that the sealing end 116*a* is the trailing end, the zipper 108 is closed. Conversely, when the slider 110 is moved so that the separating end 116*b* is the trailing end, the zipper 108 is opened.

Still referring to FIGS. 5A-D, the sides 114*a*, 114*b* taper together towards the sealing end 116*a* so that I-shaped structures 122*a*, 122*b*, respectively, apply closing pressure to seal the zipper 108 and retentive features assist aligning the zipper 108 within the slider 110. It is envisioned that alternatives to the I-shaped structures 122*a*, 122*b* may be utilized. For example, the slider 110 may simply be sized so that the sides 114*a*, 114*b* provide sealing force. The top and bottom of the I-shaped structures may be significantly more protruding to provide additional retention of the zipper 108 there between. The structures 122*a*, 122*b* may be any of a variety of shapes such at T-shaped and the like as would be appreciated by those of ordinary skill in the art.

Towards the separating end 116*b*, a dividing member 124 depends from the central upper body 112 to pry apart the profiles 130, 160 of the zipper 108. The dividing member 124 terminates in a beveled distal end 126. In one embodiment, the dividing member 124 has a varied length (i.e., tapers down from the central upper body 122). It understood that a plurality of shapes now known and later developed for the dividing member 124 will accomplish the function of separating the zipper profiles 130, 160.

Referring again to FIG. 1, when attached to the bag 100, the slider 112 further curls the ends 146, 174 of the profiles 130, 160. The ends 146, 174 want to uncurl and move the slider 112 upwards. However, the guide fingers 144, 172 prevent the upward motion.

As the slider 110 rides along the bag 100 in the closing direction, the slider 110 moves upward at the edge of the bag 100. To accommodate the upward motion of the slider 110, segments 182 of the guide ringers 144, 172 are reduced in size. Preferably, the segment 180 of the ends 146, 174 above the segments 182 are unchanged. The shortened segments 182 do not prevent the slider 110 from rising upward on the bag 100. This rise of the slider 110 raises the dividing member 124 upward to no longer separate the zipper 108. Although the shortened segments 182 have a different shape, the shortened segments 182 still function to retain the slider 112 on the bag 100. Additionally, the bag 100 has an end heat seal 184 so that as the slider 110 moves to the edge of the bag 100, the dividing member 124 rises up out of the way so that the sealing end 116*a* fully closes the zipper 108 right up to the end heat seal 184.

In another embodiment, the curled ends 146, 174 are not uniform across the entire length of the bag 100. At one end, the curled ends 146, 174 are somewhat straightened, flared upward, flattened and/or elongated. In effect, the straightened ends push the slider 110 upward and the fingers 144, 172 are sized and configured to simply deflect to allow the motion. In still another embodiment, the guide fingers are shorter along the entire length such that the slider simply rises up in the rest position. In yet another embodiment, the curled ends 146, 174 have a straightened portion in the rest area. These straight ends can be created during or shortly after the extrusion process before cooling by one or more deforming rings. A circumference of the deforming ring(s) is approximately equal to a length of the bag so that a single tooth only impacts the extruded profiles to flatten the ends in what results to be once per bag.

Figure 6:
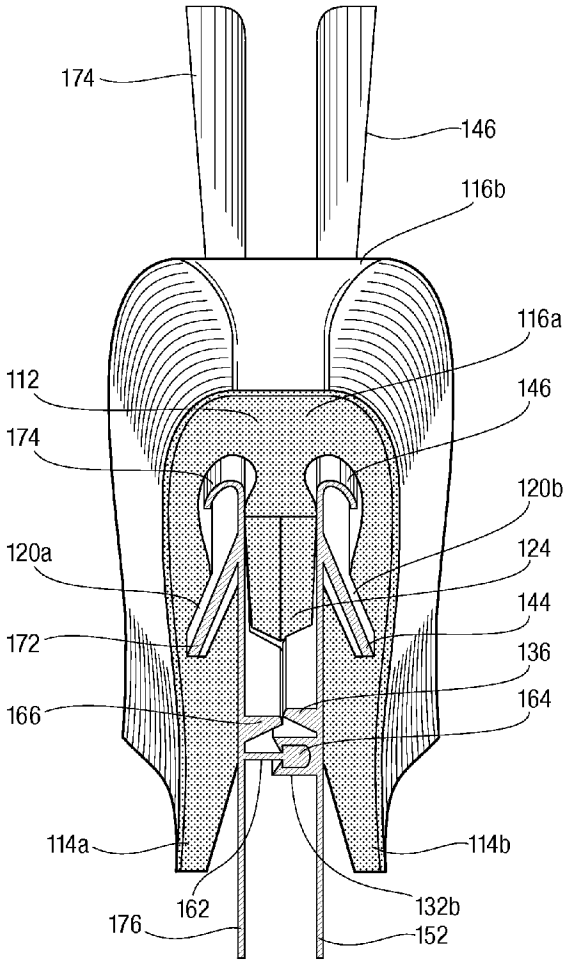
FIG. 6 is a top perspective end view of a sealing end of a closure mechanism in accordance with the subject technology.
Figure 7:
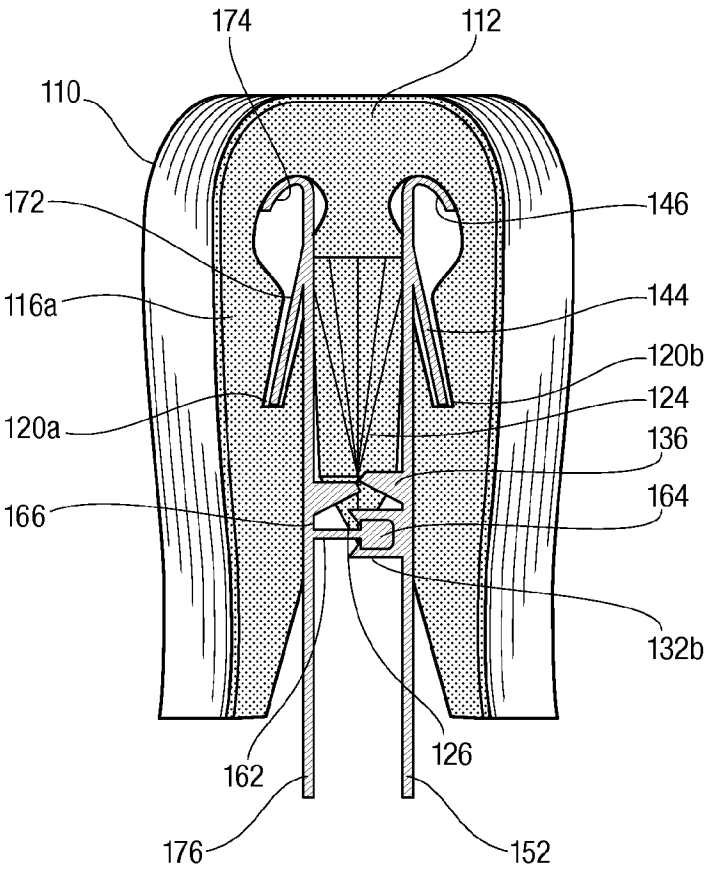
FIG. 7 is an end view of a sealing end of a closure mechanism in accordance with the subject technology.
Figure 8:
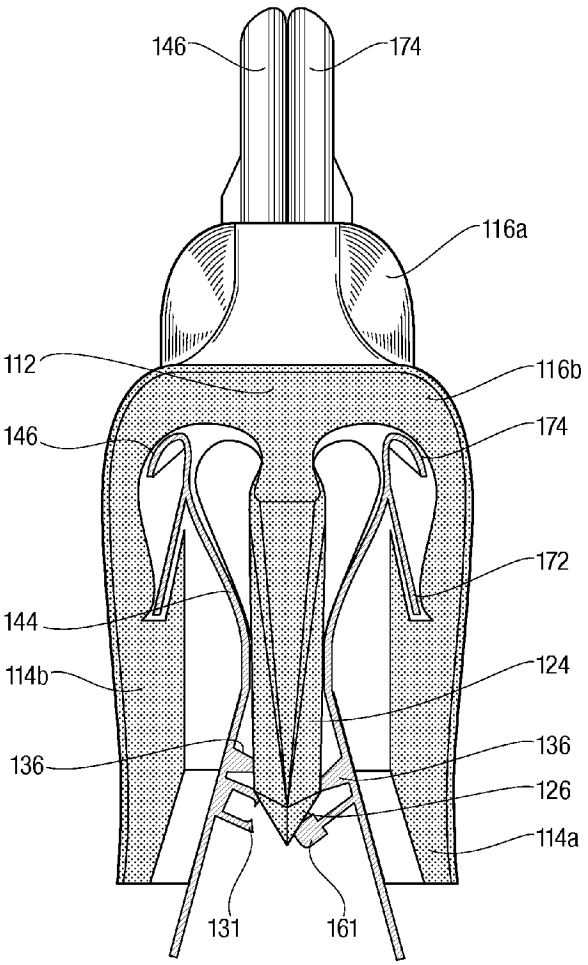
FIG. 8 is a top, perspective end view of a separating end of a closure mechanism in accordance with the subject technology.
Figure 9:
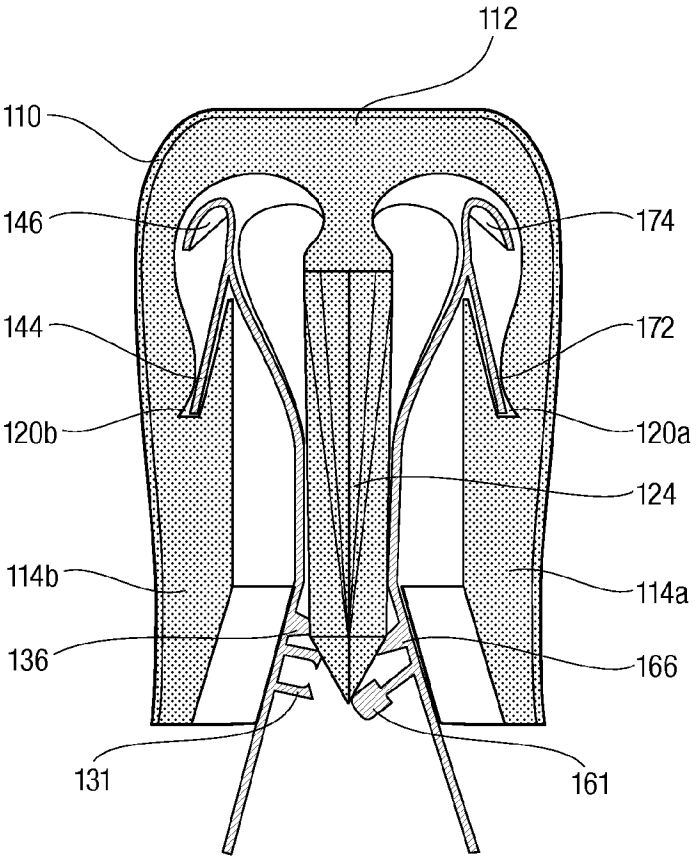
FIG. 9 is an end view of a separating end of a closure mechanism in accordance with the subject technology.
Figure 10:
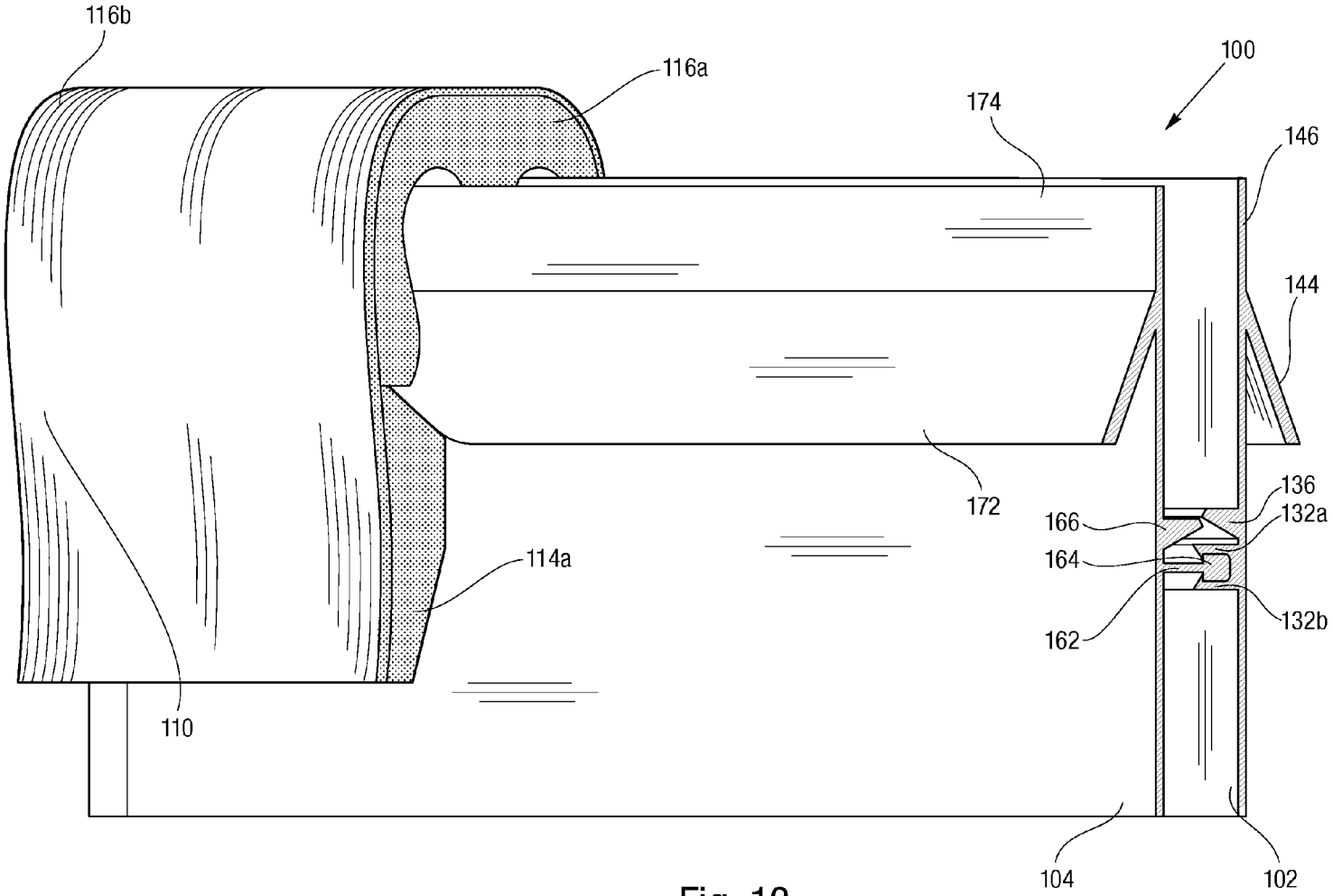
FIG. 10 is a perspective view of a closure mechanism with a slider in a rest position in accordance with the subject technology.

Referring to FIGS. 6-8, to assemble the slider 110 on the bag 100, the sides 114*a*, 114*b* are biased apart as necessary so that the lower portion of the I-shaped structures 122*a*, 122*b* passes over the guide fingers 144, 172, the branches 136, 166, and the profiles 130, 160. As the slider 110 is mounted onto the bag 100, the guide fingers 144, 172 become captured in the slots 120*a*, 120*b* so that subsequent removal of the slider 110 is difficult. Additionally, as the slider 110 moves across the bag 100 for opening and closing of the zipper 108, the guide fingers 144, 172 retain the slider 110 in the proper orientation.

Further, the curled ends 146, 174 may provide an upward bias against the top of the central channel 118 to prevent removal of the guide fingers 144, 172 from the slots 120*a*, 120*b*. The curling of the ends 146, 174 by the slider 110 also biases the slider 110 upwards (i.e., in a distal direction off the bag 100). Alternatively, the slider 110 is slid onto the bag 100 from one end or another. In any case, the slider 110 is mounted with the separating end 116*b* oriented towards the shortened segment 182.

Once mounted on the bag 100, as the slider 110 moves toward the shortened segment 182, the sealing end 116*a* presses the profiles 130, 160 together. As noted above, as the slider 110 approaches the shortened segment 182, the slider 110 rises so that the dividing member 124 no longer separates the profiles 130, 160. At the end of travel, the dividing member 124 of the slider 110 rises over the heat seal 184 so that the sealing end 116*a*, and in particular, the inner structures 122*a*, 122*b*, can completely close the zipper 108 up to the heat seal 184.

As the slider 110 moves along the bag 100, among other action, the guide fingers 144, 172 pull the end 126 of the dividing member 124 into the branches 136, 166 to splay open the zipper 108 (e.g., the separating end 116*b* opens the zipper 108). The branches 136, 166 interact with the dividing member 124 to assist with opening the bag 100. Without being limited to any particular theory, the dividing member 124 pushes the branches 136, 166 downward, which creates a separating pull upon the profiles 130, 160 to separate the head 164 from the legs 132*a*, 132*b*. The branches 136, 166 may also be pushed outward by the dividing member 124 to create a separating force upon the profiles 130, 160. In one embodiment, the female branch 166 is relatively above the male branch 136. The branches 136, 166 may be opposing each other or offset in the opposite manner. The branches 136, 166 may have other shapes such as oblong, oval, rectangular, round, prong, triangular and the like. In one embodiment, the guide fingers 144, 172 in the slots 120*a*, 120*b* separating at the separating end 116*b* assists with separating the profiles 131, 161. It is envisioned that the slider simply use a guide fingers in slots arrangement, without a dividing member to separate the profiles.

Figure 11:
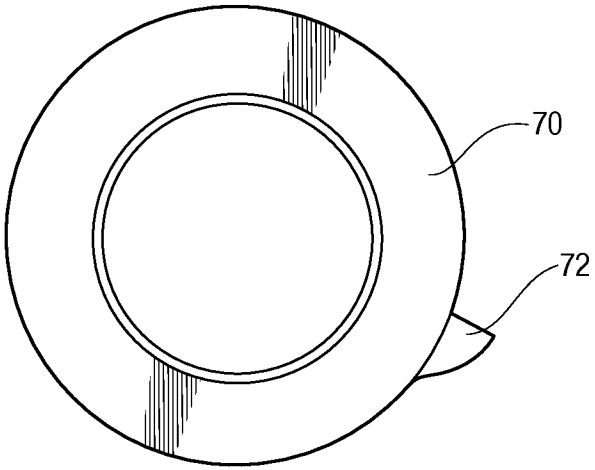
FIG. 11 is a perspective view of a deformer ring for use in a deforming apparatus in accordance with the subject technology.

Referring now to FIG. 11, a top view of a deformer ring 70 is shown. Preferably, the profile assemblies 130, 160 are extruded. In one embodiment, one or more components are separately made, then heat sealed together. For example, the guide fingers 144, 172 may be separately formed, then heat sealed in place. The deformer ring 70 has a single wave shaped tooth 72 that impacts the working material once per rotation. In this example, the working material is the guide fingers 144, 166. The deformer ring 70 would oppose a solid ring in a deforming apparatus in close proximity so that each time the tooth 72 impacts a guide finger 144, 166, the guide fingers 144, 166 are cut to create the shortened segments 182.

Figure 12C:
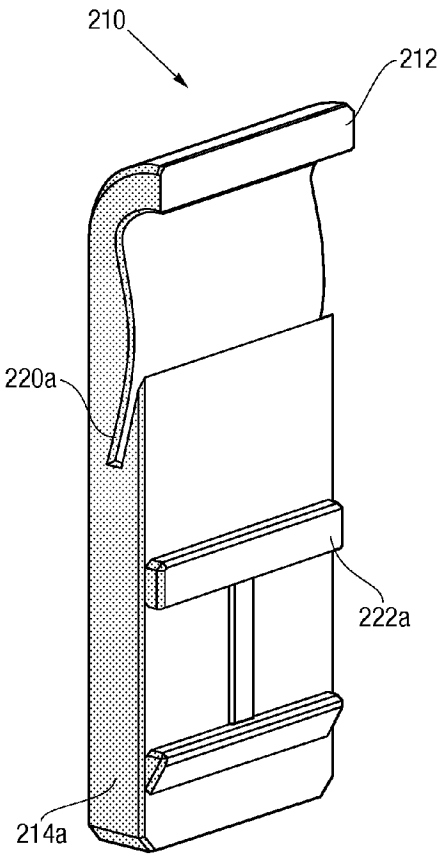
FIG. 12C is a cut-away view of another slider of a closure mechanism in accordance with the subject technology.
Figure 12B:
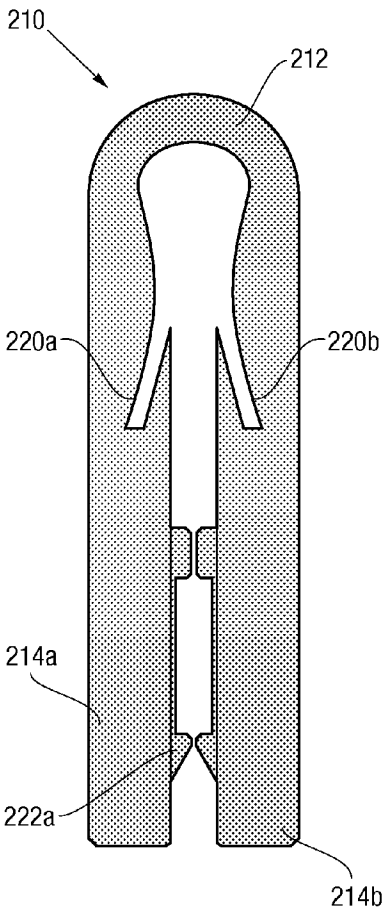
FIG. 12B is an end view of another slider of a closure mechanism in accordance with the subject technology.
Figure 12A:
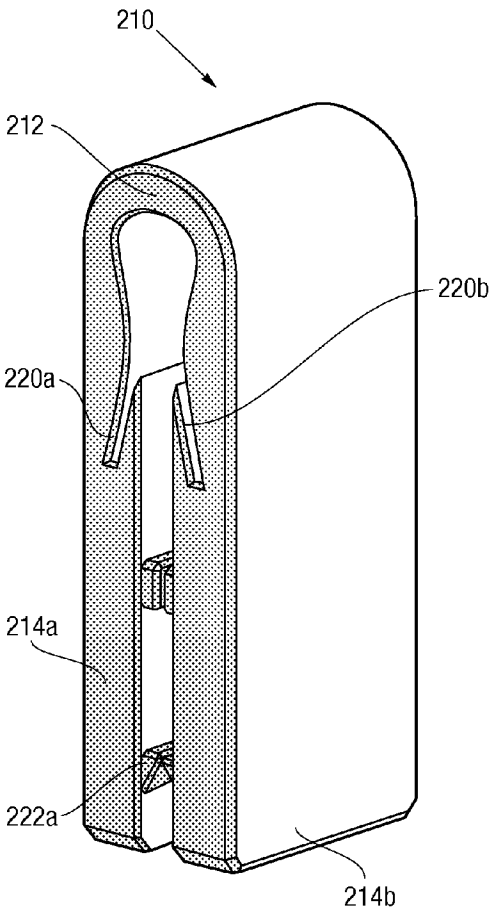
FIG. 12A is a perspective view of another slider of a closure mechanism in accordance with the subject technology.
Figure 13:
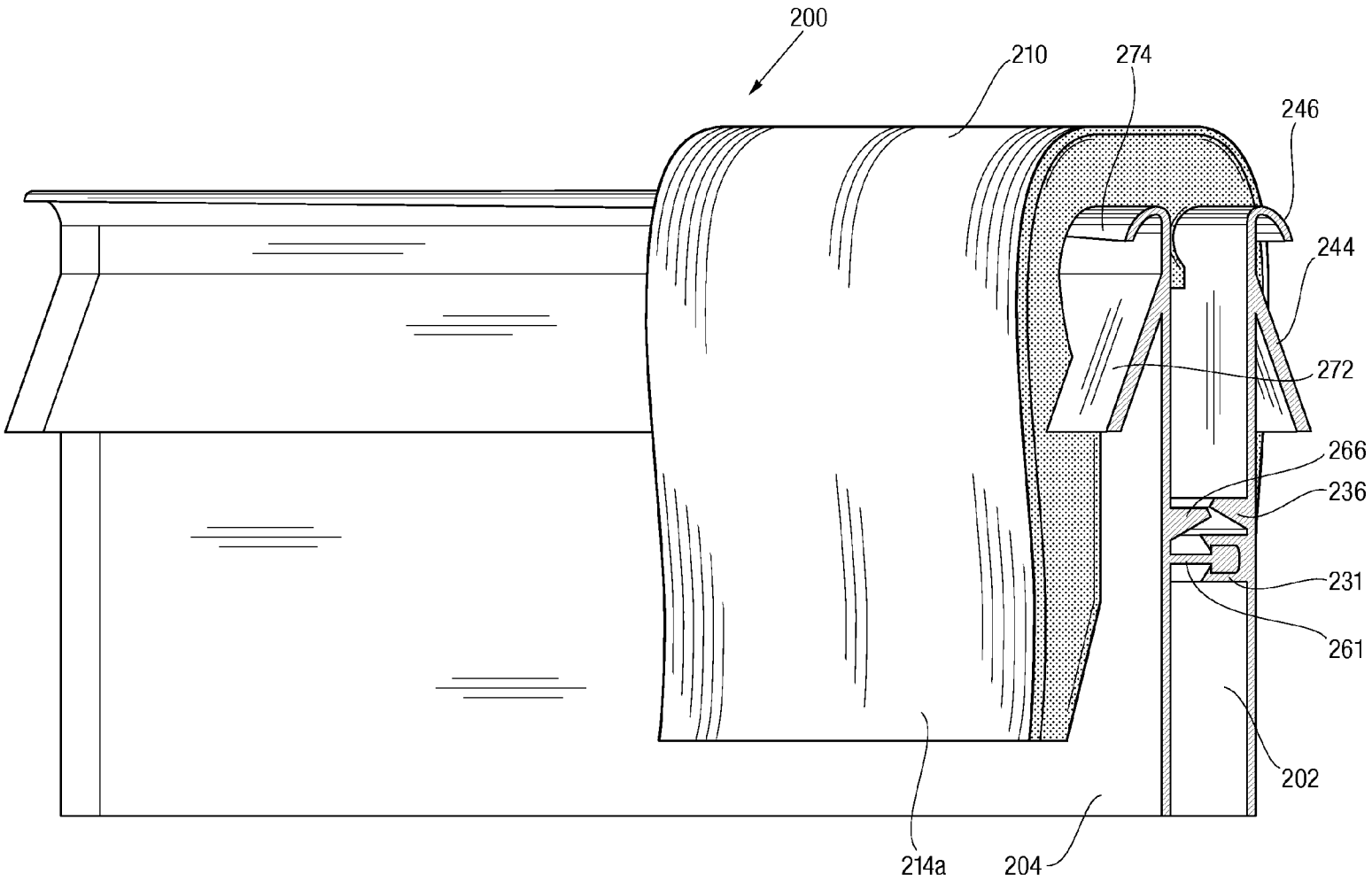
FIG. 13 is a partial perspective view of the slider of FIGS. 13A-C on a zipper of a reclosable bag in accordance with the subject technology.

Referring now to FIGS. 12A-C, perspective, end and cut-away views of another slider 210 are shown. As will be appreciated by those of ordinary skill in the pertinent art, the slider 210 utilizes similar principles to the slider 110 described above. Accordingly, like reference numerals preceded by the numeral "2" instead of the numeral "1", are used to indicate like elements. The primary difference of the slider 210 is that the slider 210 is designed to only close a zipper.

When mounted on a zipper, the slider 210 can be moved in either direction to close the zipper. In one embodiment, the end heat, seal or other mechanism is provided to prevent the slider 210 from coming off the bag 200. Typically, to open the bag, the zipper would simply manually be pulled apart.

The slider 210 includes a central upper body 212 with opposing depending sides 214*a*, 214*b*. Each side 214*a*, 214*b* defines a slot 220*a*, 220*b* that captures depending guide fingers to retain the slider 210 on the bag. The sides 214*a*, 214*b* have I-shaped structures 222*a*, 222*b*, respectively, that are spaced apart so as to apply closing pressure to seal the zipper. The tops and bottoms of the I-shaped structures 222*a*, 222*b* act as retentive features to assist aligning the zipper within the slider 210. The slider 210 does not have a dividing member.

Figure 14:
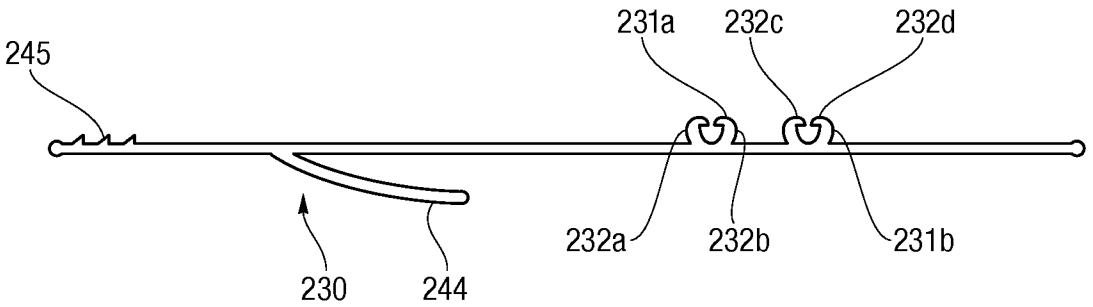
FIG. 14 is a cross-sectional view of a female groove profile assembly of a double zipper in accordance with the subject technology.

Referring now to FIG. 14, a partial perspective view of the slider 210 on a zipper 208 is shown. The primary difference of the zipper 208 is the lack of the shortened segments. Hence, in either direction, the slider 210 will completely seal the zipper 208. Preferably, there is a retaining mechanism to prevent the slider 210 from coming off the bag 200.

Figure 15:
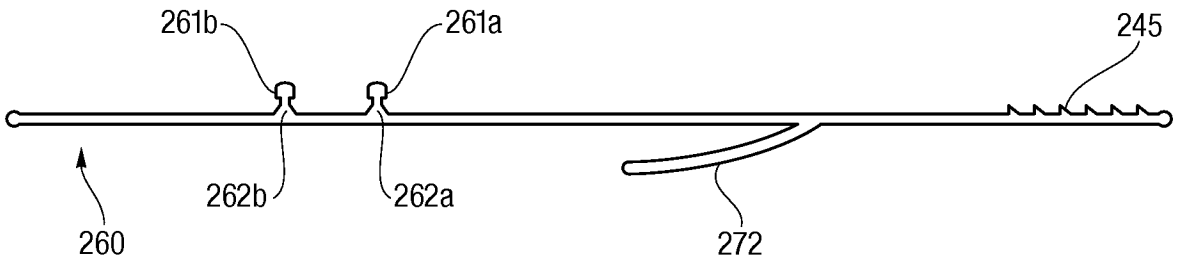
FIG. 15 is a cross-sectional view of a male rib profile assembly of a double zipper in accordance with the subject technology.

Referring now to FIGS. 15 and 16, cross-sectionals views of female and male profile assemblies 230, 260 of a double zipper are shown. As will be appreciated by those of ordinary skill in the pertinent art, the profiles 230, 260 utilize similar principles to the profiles 130, 160 described above. Accordingly, like reference numerals preceded by the numeral "2" instead of the numeral "1", are used to indicate like elements. The primary difference of the profiles 230, 260 is the double zipper feature.

The double zipper is accomplished by having the female profile assembly 230 have two female groove profiles 231*a*, 231*b*, each female groove profile 231*a*, 231*b* includes two sets of opposing legs 232*a-d*. The male profile assembly 260 has two male rib profiles 261*a*, 261*b* with stem 262*a*, 262*b* for selectively interlocking with the opposing legs 232*a-d*. By having such a double zipper, the seal of the bag may be improved. Further, on the ends, the profiles 230, 260 have a series of ridges 245 to facilitate gripping of the bag by the user. In one embodiment, the female profile assembly 230 is 3.5 cm long, the base of the guide finger 244 is 0.7 cm from the distal end, the groove 238*a* is 0.9 cm from the proximal end, the groove 238*b* is 0.8 cm from the distal end of the guide finger 244, the male profile assembly 260 is 4 cm long, the base of the guide finger 272 is 1.1 cm from the distal end, the stem 264*a* is 0.9 cm from the proximal end, and the stem 264*b* is 0.8 cm from the distal end of the guide finger 272.

It is appreciated that the subject technology would work equally well with any zipper now known or later developed, it is contemplated herein that the various features disclosed herein may be separately utilized or utilized in any combination as well as with additional or different features. For example, the bag may also include a one-way valve and/or a two-way valve (not shown) to aid in creating vacuum seal of the contents of the bag. The valve is typically located on the face of the reclosable bag, but may be on an edge of the bag or any surface or edge of the bag. The valve may also be incorporated directly into the slider, with for example, a ball valve or other feature. An example of a valve is shown in U.S. PG Pub. No. 2010/0002961 published on Jan. 7, 2010 to Armstrong et al.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., profiles, branches, structures, members, fingers and the like) shown as distinct for purposes of illustration may be incorporated within other functional elements in a particular implementation. All patents, patent applications and other references disclosed herein are hereby expressly incorporated in their entireties by reference. Additionally, each of the claims below, in whole or in part, may be combined with any other claim in any combination whether by using multiple dependencies, combining, renumbering, rearranging and the like.

While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A zipper for a reclosable bag comprising: a female profile along an opening of the bag;

a male profile along the opening and opposing the female profile, wherein the female and male profiles selectively engage to close the opening;

a slider mounted on the bag for engaging the male and female profiles together, the slider having:

a central body with depending opposing first and second sides for engaging the profiles when the slider is moved in a closing direction, and a dividing member for separating the profiles when the slider is moved in an opening direction, the opening direction being opposite to the closing direction land a guide at a side of the bag, the guide coupled to the slider, the guide having:

a first segment that is sized to cause the first and second sides to engage the profiles as the slider is moved in the closing direction, and a second segment being reduced in size with respect to the first segment, the second segment enabling the slider to rise thereby causing the dividing member to move distally away from the profiles.

2. A zipper as recited in claim 1, wherein the profiles terminate in curled ends that are further curled by the central body of the slider.

3. A zipper as recited in claim 2, wherein the slider defines a central channel for receiving the curled ends such that the curled ends create a distal bias against the slider.

4. A zipper as recited in claim 1, wherein the guide further comprises:

at least one guide finger on an outer surface of at least one of the profile assemblies, and wherein the slider forms at least one slot in at least one of the second sides for receiving first and second guide fingers.

5. A zipper as recited in claim 4, wherein the at least one guide finger includes a first guide finger on an outer surface of the female profile assembly and a second guide finger on a second outer surface of the male profile, and the at least one slot includes first and second slots in the first and second sides, respectively.

6. A zipper as recited in claim 1, wherein an area of the profiles underneath the second segment is heat sealed together.

7. A closure for a reclosable bag, comprising:

opposing members for selectively closing the bag;

a slider coupled to the opposing members for engaging the opposing members together when the slider is moved in a closing direction;

a dividing member for separating the opposing members when the slider is moved in an opening direction, the opening direction being a direction opposite the closing direction; and at least one guide extending along an outer surface of the bag, the at least one guide coupled to the slider, the at least one guide having:

a first segment that is sized to allow the slider to cause the opposing members to engage together as the slider is moved in the closing direction, and a second segment being reduced in size with respect to the first segment, the second segment enabling the slider to rise and allow the dividing member to move distally away from the profiles.

8. The closure of claim 7, wherein the at least one guide retains the slider on the reclosable bag and orients the slider to the opposing members.

9. The closure of claim 7, wherein the at least one guide defines a step at a side of the bag.

10. The closure of claim 9, wherein the at least one guide includes two opposing guides, each guide being on the outer surface.

11. The closure of claim 10, wherein the bag terminates in a pair of outwardly curled edges extending from an open end of the reclosable bag;

the slider including two reciprocal, curved surfaces, forming cavities therein configured and arranged to receive and bend the curled edges, the curved surfaces further tapering inwards before flaring outwards again, forming two opposing lateral channels configured and arranged to receive the guides therein, whereby compression of the curved edges engages the guides within the channels.

12. The closure of claim 11, wherein bending the curled edges form a bias that causes the slider to rise on the reclosable bag at the step.

13. The closure of claim 7, wherein the opposing members include a male rib profile and a female groove profile for closing the bag, and the slider includes a dividing member for selectively separating the profiles.

14. A zipper for a reclosable bag comprising:

a female profile along a first backing to form an opening of the bag;

a male profile along a second backing and opposing the female profile, wherein the female and male profiles selectively engage to close the opening;

a slider slidingly mounted on the bag for engaging the male and female profiles together, the slider having a central body with depending first and second sides for closing the profiles and a dividing member for separating the profiles depending upon a direction of movement of the slider; and a guide extending along an outer surface of the bag, the guide coupled to the slider, the guide having:

a first segment that is sized to allow the slider to cause the first and second sides to engage the profiles as the slider is moved in a closing direction, and a second segment being reduced in size with respect to the first segment, the second segment enabling the slider to rise thereby allowing the dividing member to move distally away from the profiles.

15. A zipper as recited in claim 14, wherein the guide includes:

a first guide finger on the first backing, wherein the first backing terminates in a first end; and a second guide finger on the second backing, wherein the second backing terminates in a second end, wherein the first and second sides define first and second slots, respectively, for receiving the first and second guide fingers such that the slider compresses the first and second ends and the guide fingers together.

16. A zipper as recited in claim 14, further comprising:

at least one branch adjacent to at least one of the profiles so that as the slider is moved to separate the profiles, the at least one branch contacts the dividing member to assist with separating the profiles.

17. A zipper as recited in claim 16, wherein the at least one branch includes two opposing branches that are trapezoidal-shaped and located adjacent to the respective profile and spaced distally from the profile.

* * * * *